United States Patent [19]

Tobisawa et al.

[11] Patent Number: 4,995,339

[45] Date of Patent: Feb. 26, 1991

[54] COATING APPARATUS

[75] Inventors: Seiichi Tobisawa, Hachioji; Takemasa Namiki, Iruma; Shigetoshi Kawabe, Hachioji, all of Japan

[73] Assignee: Konica Corporation, Tokyo, Japan

[21] Appl. No.: 311,250

[22] Filed: Feb. 16, 1989

[30] Foreign Application Priority Data

Feb. 17, 1988 [JP] Japan ..... 63-34859
Mar. 4, 1988 [JP] Japan ..... 63-50695

[51] Int. Cl.[5] ..... B05C 3/12; B05C 5/00
[52] U.S. Cl. ..... 118/410; 118/419
[58] Field of Search ..... 118/407, 400, 410, 419, 118/411, 413, 416, 423, 424, 123, 124, 209, 266, 200

[56] References Cited

U.S. PATENT DOCUMENTS 4,480,583 11/1984 Tanaka et al. ..... 118/410
4,537,801 8/1985 Takeda ..... 118/410
4,577,362 3/1986 Tanaka et al. ..... 118/123
4,681,062 7/1987 Shibata et al. ..... 118/407

FOREIGN PATENT DOCUMENTS 3144655 7/1982 Fed. Rep. of Germany .

*Primary Examiner*—Willard Hoag
*Attorney, Agent, or Firm*—Finnegan, Henderson, Farabow, Garrett and Dunner

[57] ABSTRACT

Disclosed is a coating head for coating a solution on a flexible support which is moved so as to run along a coating surface of the coating head. The coating surface is slitted so as to form a front face, a back face in order in the moving direction of the flexible support, and a slit therebetween so that the coating head extrudes the solution through the slit to the flexible support. The front face has an arc surface with a curvature radius of $r_1$ and the back face wholly forms an arc surface with a curvature radius of $r_2$ in the following equations 3 mm $<r_2<$ 20 mm and 1 mm $<r_1<r_2/2$. Further, at least a part of the back face projects beyond the tangent line at the downstream end of the front face.

8 Claims, 5 Drawing Sheets

A
B
C
CH
2
3
1
1a
1b
1c
$\alpha_1$
$\alpha_2$
$r_1$
$r_2$
$O_1$
$O_2$
$\theta_1$
$\ell_1$
$\ell_2$
$\ell_3$ A
CH
S
1
2
3
4
5
6
7
L
$\ell_2$
$\theta$

COATING APPARATUS

BACKGROUND OF THE INVENTION

This invention relates to an extrusion-type coating apparatus, especially to a coating apparatus that allows trouble-free coating in manufacturing magnetic recording media. A similar apparatus is disclosed in copending U.S. patent application Ser. No. 07/297,756 of Seiichi Tobisawa et al., entitled Coating Apparatus, filed on Jan. 20, 1988.

A variety of coating processes are available; these include roll coating, gravure coating, extrusion coating, slide-bead coating, and curtain coating.

Magnetic recording media are available by coating magnetic coat solutions commonly by means of roll coating, gravure coating, and extrusion coating. Among these, extrusion coating is preferable since it provides uniform coat-film thicknesses.

The magnetic recording medium itself, however, has improved rapidly in recent years; its material consists of an oxidized magnetic powder which has a high BET value, and barium ferrite. High viscosity coating solutions are also being increasingly used. For the purpose of higher productivity, high-speed coating is in growing demand.

Conventional techniques in the extrusion coating process intended for manufacture of the magnetic recording medium is described in Japanese Patent Publication Open to Public Inspection (hereinafter referred to as Japanese Patent O.P.I. Publication) No. 84771/1982, No. 104666/1983, and No. 238179/1985.

In fact, said extrusion coating process provides uniform coat film thicknesses, but only under good coating conditions limited to a narrow range; said extrusion coating process, however, often fails to attain desired coating under the high viscosity, high-speed coating conditions described above.

Although a coating head with a specially designed shape enables high-speed coating at a rate of 300 m/min or more with a thick film thickness, said extrusion coating process cannot provide a marketable magnetic recording medium because of uneven thickness, greatly out of tolerance, which is inevitable under high-speed conditions.

Under these types of coating conditions, thin film (30 μm or less before drying) coating in particular, said extrusion coating process causes failures which lead to major problems. For example, a coating film is partially peeled off by foreign matter, dust, coagulating particles, etc. which are deposited on the base material and transferred to or caught by the back edge face, the film thickness is partially thickened, and the base material is shaved by the front edge, especially the corner at the downstream end of the front edge, and the resulting base waste is deposited. In particular, a high viscosity coating is likely to cause a crosswise streak failure as a result of the stick-skip motion of the base material, it also causes noise and fluctuations of output.

Various countermeasures are taken for the above failures. A typical example is the technique disclosed in Japanese Patent O.P.I. Publication No. 238179/1985 (hereinafter referred to as prior technique).

The prior technique is derived from the technique described in Japanese Patent O.P.I Publication No. 104666/1983. In this technique the back-edge face 2' has a triangular cross section, as shown in a hypothetical line in FIG. 9. This is to prevent foreign matter from overriding the triangular cross section, and the foreign matter thus blocked is likely to deposit in the solution sump P thereby causing a streak failure. In the prior technique, not only the back-edge face 2, is smoothed as shown in a solid line in FIG. 9, but $\Theta_1$ and $\Theta_2$ are so designed as to satisfy the conditions of formula (1).

$$\Theta_1 < \Theta_2 \leq 180^\circ \quad (1)$$

In fact, the prior technique effectively reduces the incidence of failures in that no foreign matter is left in the solution sump P, but it is still subject to the failure caused by waste from the base material whose surface is shaved by the downstream end B of the front edge face 1', this is where contact pressure between the base material and downstream end B is concentrated because the running angle of the base material changes abruptly.

On the other hand, in thick-film coating, the base waste failure is reduced to a certain extent because a contact pressure of the base material to the downstream end B is partly distributed to the back-edge face, as compared with thin-film coating. The coating film thickness is solely dependent on the balance between the pressure of the coating solution on the back-edge face, and the pressing force of the base material on the back edge face during running. This balance is so fine that the slightest unbalance results in stepped unevenness which means thicknesses differ along the running direction of the base material, or streaks along the running direction and with different thicknesses in the crosswise direction. The higher the coating speed, and the thicker the film thickness, the greater is the incidence of coating failure.

The first aim of the invention is to provide a coating apparatus that allows excellent coating under conditions of a thick film thickness, and high-speed coating without causing the stepped unevenness and streaks.

FIG. 9 shows the prior technique. Air is included between the front face 1' and the surface of the base material while the base material is running, and is blocked at the downstream end B of front face 1' whereby air is not allowed to enter the coating solution. However, this design causes base waste to deposit. The present inventors have found that a contact force of the base material is effectively distributed to the back face by projecting at least a part of the back face from the tangent line $l_1$ at the downstream end B of the front face. As the back face is projected, however, a contact force between the downstream end B and the base material is weakened accordingly. In particular, when the base material runs at a rather high rate, more boundary air on the base material surface flows over the downstream end B so that the air is not securely blocked, with the result that pinhole failures on the sheet are likely to occur after coating.

The base material applies pressure to the front face and back face and the components of the forces are then balanced with each other, as stated above. The forces and their balance or distribution of components have so delicate an influence on coating properties that a coating head with an optimum shape is involved. However, there is a limitation on shape design for improving coating properties. For example, if coater heads are changed each time a base material with a different specification flows, productivity is reduced.

In addition, it is extremely difficult to eliminate uneven thicknesses of the base material in the cross-wise direction, because a different tension acts on the base material in that direction.

The second aim of the invention is to provide a coating apparatus that successfully prevents coating failures such as uneven film thicknesses and allows coating conditions to be changed easily.

The coater head is generally made of stainless steel.

However, when a new roll of the base material is charged or any trouble occurs during coating, and the base material 1 is separated from the coater head CH as shown in FIG. 6, the coating solution A' drips down along the surface of front edge or front face 1 from slit 2. For this reason it is common practice to clean front edge 1 with a solvent before the coating apparatus is restarted.

However, insufficient cleaning or an especially extended shutdown time causes the coating solution to solidify or for dry waste to remain on front edge 1, and waste is coated on the base material after coating is restarted, causing a coating failure. The coating failure is diminished within several minutes, during which the high speed coating produces a failure length of several hundreds meters from the restart position, causing reduction in productivity (yield).

The third aim of the invention is to provide a coating apparatus that successfully prevents coating failures caused by waste of the coating solution which remains on the edge face of the coater head, and that ensures an improved yield.

In addition to the extrusion-type coating apparatus as described above, the present invention discloses another method of manufacturing magnetic recording media while adding a curing agent in-line.

Japanese Patent O.P.I Publication No. 10773/1983 discloses a method for in-line addition of a curing agent, when performing roll coating with a magnetic coating solution, for creating higher stability of the magnetic coating solution and improving characteristic such as squareness ratio.

In fact, the method of in-line addition of a curing agent is an excellent method of improving stability of a magnetic coating solution. More particularly, if a curing agent is added before the magnetic coating solution is conditioned, the curing agent reacts with the binding agent in the solution tank, solution viscosity rises with time, and coating properties depart from the tolerance range, with the result that no magnetic recording medium is manufactured to the required quality level unless the magnetic coating solution is finely re-conditioned each time when required. In fact, the in-line addition method is thoroughly free from such trouble, thereby improving the stability of the coating solution.

However, it should be noted that the in-line addition method has been employed mainly by the coating apparatus that applies a coating solution kept in a vat such as for gravure coating, as described in Japanese Patent O.P.I. Publication No. 10773/1983. More particularly, the coating solution in the coating solution supply line is not totally applied on the base material but only a part of the solution is applied, with the residue left in the vat. A residual solution in the vat causes the reaction to progress in the vat, the viscosity of the coating solution to rise with time, and the coating solution partially become highly viscous, with the result that the stability of the coating solution is insufficiently maintained.

In particular, when a binding agent has a polar group, the performance of the tape is greatly deteriorated because of the high thixotropy of the coating solution.

The fourth aim of the invention is to provide a method of manufacturing magnetic recording media with excellent characteristics by improving the stability of the coating solution.

The magnetic tape, which is a magnetic recording medium, has a back-coating layer formed on the surface of a base support material which is opposite to the magnetic layer surface, whether through an uncoated layer or not. This is done to improve the running stability and to reduce the friction resistance between tapes.

After the magnetic layer is coated, the back coating layer is commonly coated by means of gravure coating, reverse coating, or kiss-roll coating.

However, when the back-coating layer is formed by conventional means after the magnetic layer is coated, the magnetic tape drops out because the magnetic layer is nipped by the rubber roll while the back coating layer is coated, dirt deposited on the roll or contained in the coating solution is pressed to the magnetic layer to produce blemishes or scratches. In recent years, magnetic recording media with lower dropouts are in growing demand, and require an improved coating method.

The fifth aim of the invention is to provide a method of manufacturing magnetic recording media by forming a backcoating layer in a series of coating processes while reducing dropouts.

SUMMARY OF THE INVENTION

The primary aim of the invention is to provide a coating apparatus that exhibits excellent coating properties under conditions of thicker film and high-speed coating, without causing failures such as stepped unevenness and streaks, this is successfully attained with the configuration described below.

In the apparatus that coats the coating solution on the surface of the flexible base material which continuously runs along the front-edge face or front face and back-edge face or back face of coater head by continuously extruding coating solution from a slit between both faces. These faces are constructed so that the front face has an arc with a curvature radius of $r_1$ at the end, and that the whole back face forms an arc with a curvature radius of $r_2$, wherein these radii satisfy the following conditions;

$$3\ \text{mm} < r_2 < 20\ \text{mm}$$

$$1\ \text{mm} < r_1 < r_2/2, \text{ and}$$

At least a part of the back face projects beyond the tangent line at the end of the front face.

It is not clear why the configuration of the present invention has excellent coating properties even in thick-film and high-speed coating, but it may be attributed to the following points:

(1) The back face projected beyond the tangent line at the end of the front face prevents the base material from coming into contact with the end of the front face and protects the base material from being shaved, thus preventing occurrence of base waste. Therefore, even if the base material is forcibly pressed to the coating head, a waste failure may not result. It follows that the pressure of extruding the coating solution is well balanced in high level with the pressing force of the base material onto the back face, whereby, sensitivity to factors of changing film thickness may be sluggish and stepped, unevenness or streaks are successfully prevented even under conditions of thick film and high-speed coating.

On the other hand, even if stick-slip (wavy) motion is added, the base material keeps in contact with any point at the end of the front edge. This means that no waving occurs, eliminating stepped unevenness.

(2) In addition, the curvature radius $r_1$ exceeding 1 mm prevents the base material from having contact with the front face at an acute angle and prevents base waste from occurring, while the radius less than $r_2/2$ prevents boundary air from intruding through a clearance between the front face and base material. On the other hand, a curvature radius $r_2$ exceeding 3 mm inhibits the coating solution from an abrupt change in flow rate between the slit outlet and the end of the back face, while the same radius less than 20 mm allows a shearing force to act on the coating solution until the solution reaches the end of the back edge when performing high speed coating, thus assuring coating to a uniform film thickness.

The second aim of the invention is to provide the coating apparatus that allows easily changing coating conditions while preventing coating failures such as uneven thicknesses in the crosswise direction. This is successfully attained with the configuration described below.

In a coating apparatus comprising a coater head which coats the coating solution on the surface of the flexible base material, which continuously runs along the front face and back face of the coater head, the coater head continuously extruding coating solution from a slit between both faces, a pair of support rolls arranged on the upstream and downstream sides of the coater head in order to force the base material onto the coater head, and a fluid pressure means provided between the support rolls.

Fluid pressure means apply fluid pressure to the outer surface of the base material from the side opposite the coater head side of the base material.

The fluid pressure means related to the invention (pressurizing base material with fluid), on the outer surface of the base material at the position of the back face, the discharge pressures of air, etc. may be changed in the crosswise direction of the base material. In this way film thickness in the crosswise direction may be controlled for uniformity.

The fluid pressure means may be provided at the front face so that a fluid pressure is added to a tension of the base material. This design prevents inclusion of air and resulting pinhole failures. The fluid pressure means may also be provided at the back face so that a high viscosity coating solution or thin film can be coated easily by regulating the pressure due to a tension on the front face.

A lower tension is sometimes necessary, for example, when a base material with an underlayer is overcoated or when dual layers are coated. In these cases, the fluid pressure means may be provided at the back face for uniform and stable coating.

The third aim of the invention is to provide a coating apparatus that allows yield to be increased by preventing coating failure caused by coating solution waste depositing on the edge surface of the coater head. This is successfully attained by providing at least one edge surface of the coater head with a material whose contact angle with water $\Theta$ is 63° or more.

The invention uses at least one edge surface made up of the material whose contact angle with water is 63° or more, thereby the coater head is provided with excellent liquid repellency. As a result, even if coating is suspended, the coating solution immediately drips from the edge surface, leaving hardly any residue on the edge surface. Therefore, an extended time before a restart never causes or is least likely to cause waste to deposit, thus reducing coating failures to a minimum.

The fourth aim of the invention is to provide a method of manufacturing magnetic recording media with excellent characteristics by improving the stability of the coating solution. This is successfully attained by the following means. A curing agent is added to the magnetic coating solution containing fine ferromagnetic powder dispersed in a binder, while the mixture thus prepared is left under a shearing stress of $1\times10^2$–$1\times10^5$ dyne/cm$^2$ for at least five seconds before being coated on the base material. The magnetic coating solution (with a curing agent) is then led to the coating apparatus and is continuously extruded from the slit between the front face and back face.

The invention adds a curing agent to a magnetic coating solution that has been prepared as specified whereby the final coating solution has an improved stability. In addition, the invention uses the extrusion type coating apparatus, which discharges the specified total quantity of final solution through the supply line from the slit of the coater head, with no coating solution left in a vat, etc. on the way. This design prevents the coating solution from time-dependent deterioration and assures excellent performance of the magnetic recording medium. In addition, the coating solution is free from a change with elapsed time, eliminating the need for adjusting the coater head each time that some deterioration of coating solution is detected, thereby improving productivity.

The fifth aim of this invention is to provide a method of manufacturing the magnetic recording medium with the back coating layer formed in a series of coating processes while reducing dropouts, is successfully attained by the following process. The base material is coated with a magnetic layer on one surface, dried and calendered. Then, the other surface of the base material is forced to the front face and back face, while being coated with the coating solution extruded from the slit between the front and back faces in order to continuously form a back coating layer.

This invention completes a series of magnetic layer coating operations, including coating, drying, and calendering of the magnetic layer, before forming the back coating layer, thus preventing dropouts.

More particularly, the extrusion coating head does not extrude the coating solution to the magnetic layer surface of the base material but only to the reverse surface. It follows that dirt, if there is any in the coating solution, is sequentially extruded onto the reverse surface and never influences the magnetic layer surface. In addition, the back coating layer is coated after a series of magnetic layer coating operations has been completed and before the base material is rewound. Therefore, the back coating layer may not be transferred to a group of feed rolls and calender rolls to which the base material is subjected before the completion of magnetic layer coating process.

On the other hand, to prevent dirt causing dropouts in the magnetic layer, a knife coater seems to be an alternative instead of the roll-type coating system in forming the back coating layer. However, considering that the back coating layer is generally an extremely thin film of 3 μm or less and that uniformity in the crosswise direction is required, the knife coater system is not feasible because of failure to assure uniformity of film thickness. The present inventors have found that only the extrusion system meets the requirements of feasibility.

BRIEF DESCRIPTION OF THE DRAWINGS

The accompanying drawing, which are incorporated in and constitute a part of this specification, illustrate embodiments of the invention and together with the description, serve to explain the details, features and advantages of the invention.

DETAILED DESCRIPTION OF THE INVENTION

Figure 1:
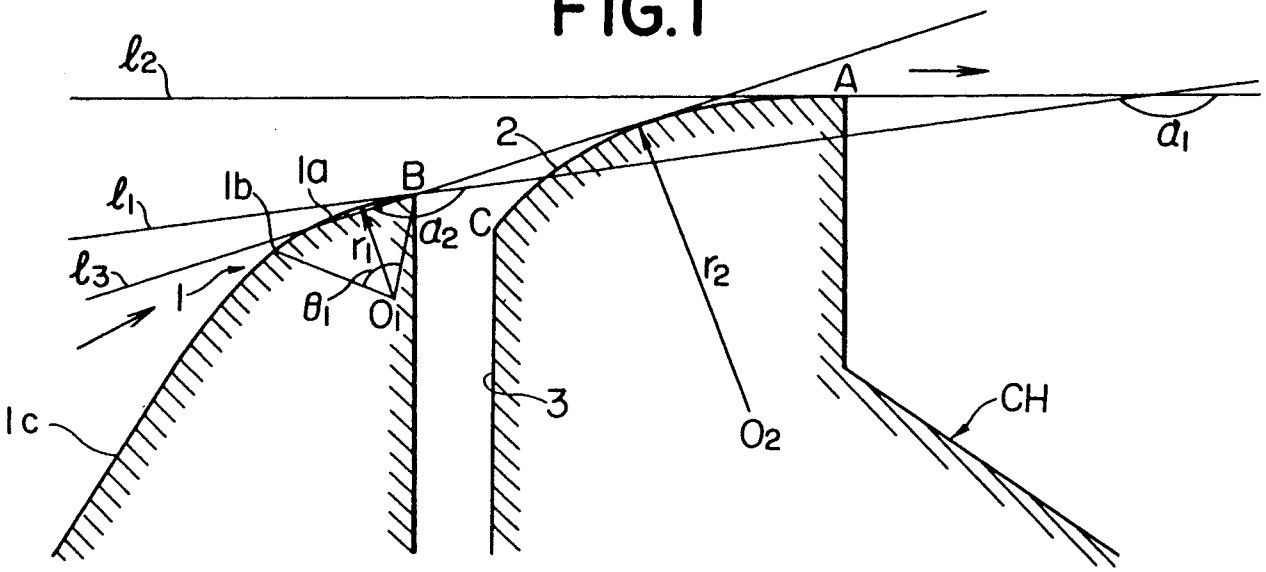
FIG. 1 illustrates a cross section of the coater head in the coating apparatus of the present invention.
Figure 9:
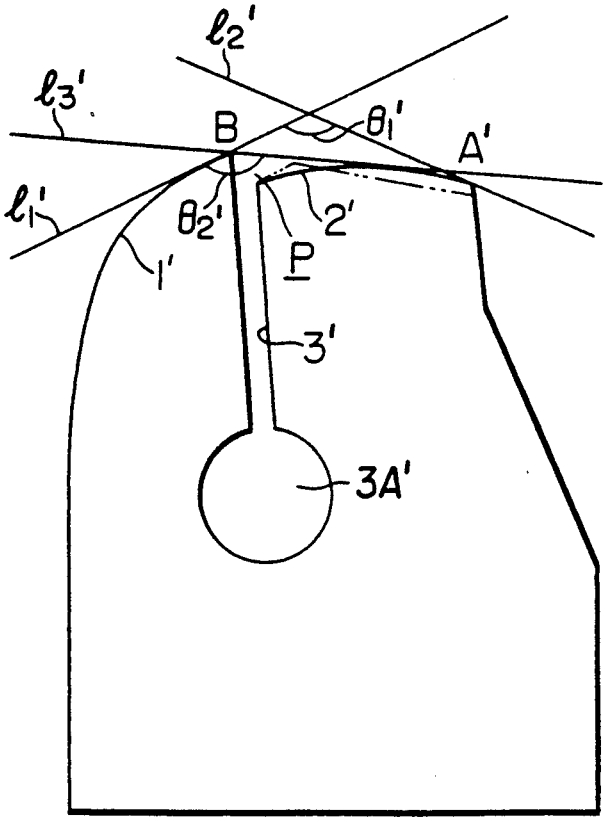
FIG. 9 PRIOR ART
FIG. 9 illustrates a cross sectional view of a conventional coating apparatus.

FIG. 1 shows the critical part of the extruder relating to the invention. The extruder is equipped with front face 1 with curvature radius $r_1$ on the surface on the upstream side, back face 2 with curvature radius $r_2$ on the surface on the downstream side, and slit 3 which is located between front face 1 and back face 2 and which is connected to coating solution pocket 3A. (See FIG. 9.)

There is an end part or end section la of curvature radius $r_1$ on front face 1. End section 1*a* is of such length that a line connecting curvature radius center $O_1$ to end B is at an angle of 30° to 120°, preferably of 75° to 100°, with a line connecting the center $O_1$ to turning point 1*b*. An introducing face or introducing segment 1*c* to the turning portion 1*b* may be a planar (straight line) or a curve.

On back face 2, on the other hand, curvature radius $r_2$ is designed to meet requirement $3\ mm < r_2 < 20\ mm$ over from exit line C of slit 3 to its end.

In relation to curvature radius $r_2$ on back face 2, curvature radius $r_1$ at end part 1*a* of front face 1 is designed to meet requirement $1\ mm < r_1 < r_2/2$.

In addition, a part of back face 2 is projected (almost upward in FIG. 2) from tangent line $l_1$ at the downstream end B of front face 1.

This condition may be expressed in the following formula (2) where tangent line $l_1$ is at angle $\alpha_2$ with line $l_3$ connecting back face 2 to downstream end B, and tangent line $l_1$ is at angle $\alpha_1$ with tangent line $l_2$ at downstream end A of back edge face 2.

$$\alpha_2 < \alpha_1 < 180° \quad (2)$$

For the base material related to the invention, a variety of materials may be used including plastic film, such as polyester film, paper, the sheet laminating plastic film with paper, and metallic sheet. Any flexible material may be used irrespective of quality and formation.

COMPARATIVE TEST (1)

The effect of the invention is clarified using the following examples.

EXAMPLE 1-1

A magnetic recording sheet is made up of polyethylene terephthalate film of 15 μm in thickness as basic support material on which a high viscosity magnetic coating solution of 4000 cps is coated to a wet film thickness of 40 μm; the coating solution contains metal powder (with a BET value of 60 $m^3/g$).

For the purpose of the present test, two coating apparatus were prepared: One is related to the present invention, and the other to the prior technique. Tests were performed for coating properties, with coating rates being changed; Table 1 lists the test results.

TABLE 1

| Coating rate | Prior technique | Present invention |
|---|---|---|
| 100 m/min | o | o |
| 200 m/min | o | o |
| 300 m/min | o-Δ | o |
| 400 m/min | Δ | o |
| 500 m/min | x | o |

Symbols:

x: Excessive uneven thicknesses are obviously found.

Δ: Many uneven thicknesses are found.

Δ-0: Uneven thicknesses are found in some sections.

0: Coating properties are satisfactory.

The base material was coated over a length of 500 m or more, except for those indicated by symbols x and Δ, where coating was stopped in a length of about 100 m because unevenness was clearly seen in visual inspection.

For the purpose of the present test, curvature radii $r_1$ and $r_2$ of the coating head of the invention were 3 mm and 8 mm, respectively.

EXAMPLE 1-2

The test was performed under the same coating conditions as the test in Example 1—1, except that a coating rate of 400 m/min was used. For the purpose of the present test, curvature radii $r_1$ and $r_2$ were changed to check for coating properties. Table 2 lists the test results.

TABLE 2

| $r_1$ | $r_2$ | Coating properties | Remarks |
|---|---|---|---|
| 0.5 mm | 8 mm | x | Failure results from air inclusion. |
| 1.5 mm | 8 mm | o | |
| 3 mm | 2.5 mm | x | Many streaks. |
| 3 mm | 25 mm | x | Apparent crosswise unevenness. |
| 4 mm | 6 mm | x | Apparent unevenness. |

The above tests have proven that the present invention ensures good coating properties even in thick-film and high-speed coating.

The configuration intended to attain the second aim of the invention is now described in detail; see FIGS. 2 to 5.

Figure 3:
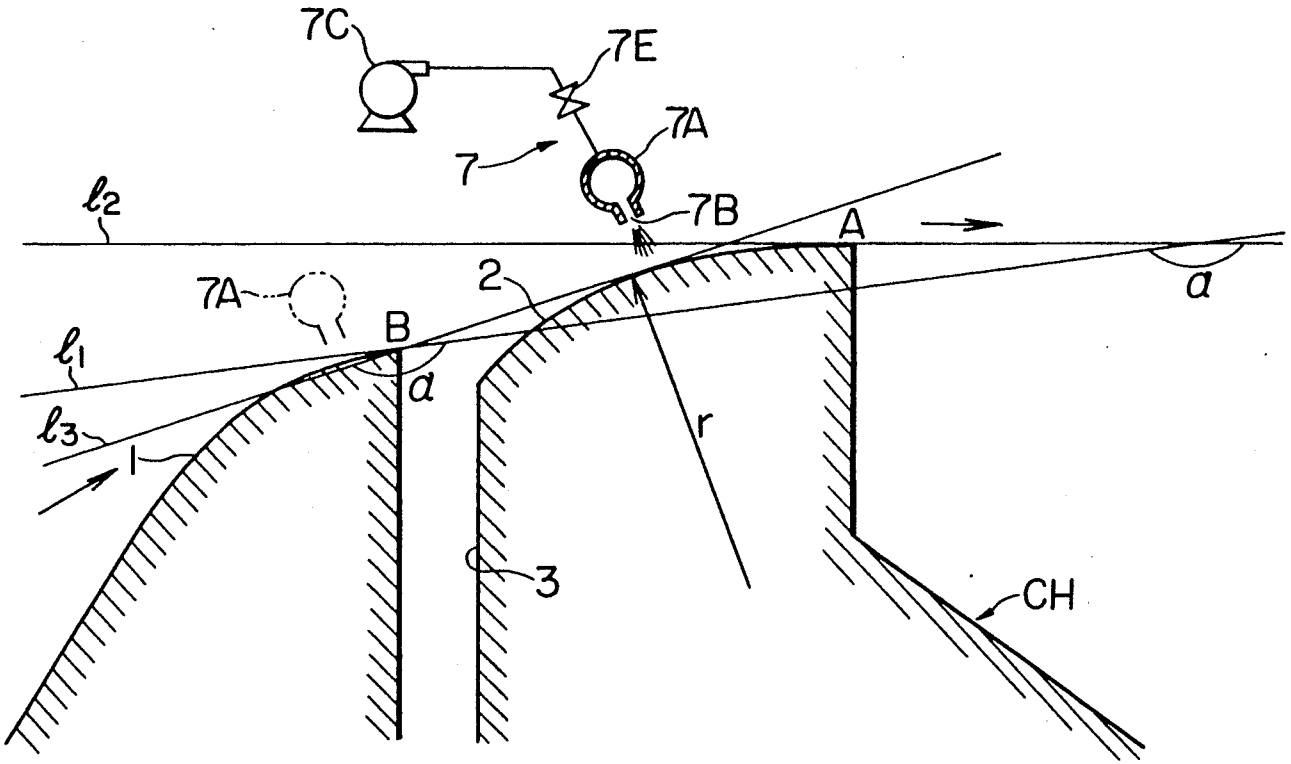
FIG. 3 illustrates cross sectional view of the enlarged main part of the coater head.
Figure 4:
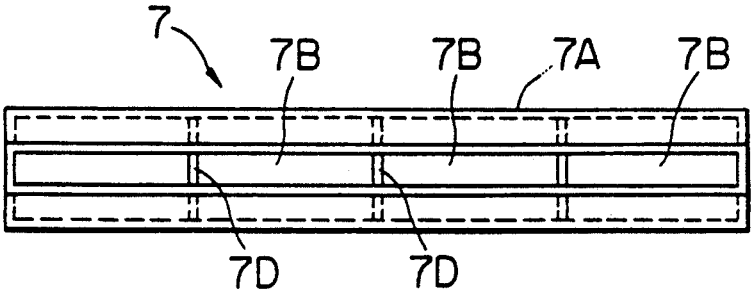
FIG. 4 illustrates an oblique view of the blow-out nozzle viewed from the diffuser (slit) of the nozzle.

FIG. 3 shows the positions between the critical part of extruder coater head CH (Refer to FIG. 1.) and the fluid pressure means.

Figure 2:
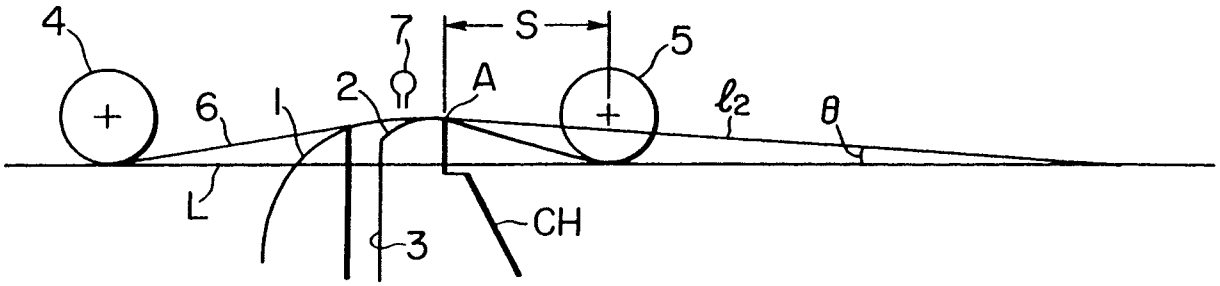
FIG. 2 illustrates the coating apparatus of the present invention.

Support rolls 4 and 5 are located on upstream and downstream sides of coater head CH, as shown in FIG. 2. The base material is led to the downstream side through upstream support roll 4, front face 1, back face 2, and downstream support roll 5 in that order.

While the base material 6 runs toward the downstream side, it is forced to front face 1 and back face 2 by coater head CH, which projects from the base material running along line L.

In the present invention, a fluid pressure means 7 is provided between upstream support roll 4 and downstream support roll 5 in order that means 7 blows fluid, such as air to front face 1 and back face 2 on the side opposite to coater head CH of base material 6.

FIGS. 2 and 3 show a typical example of fluid pressure means 7. The blow-out nozzle is formed by slit 7B on tubular header 7A which is connected to compressor 7C.

The blow-out nozzle has a length almost equal to the width of base material 6. To change pressures blown in the crosswise direction of base material 6, a preferable means is as follows: slit 7B is separated by partition wall 7D, the plural exit tubes of compressor 7C are branched on the way, and each branch is provided with pressure control valve 7E.

Air blown out from the blow-out nozzle forces base material 6 toward coater head CH. Gas such as air should preferably be used as a working fluid in view of easy handling and maintenance, but a liquid such as water may be substituted for it. The blow-out nozzle may be located in an appropriate position, subject to conditions described in above pressure regulation in crosswise direction. A blow-out nozzle may be provided on each of front face 1 and back face 2, each blow-out nozzle may be designed to provide a pressure different from that of the other nozzle. Blow-out pressure may be set to any appropriate value depending on the distance to base material 6, tension of base material 6, coating rate, viscosity of the coating solution, intended film thickness, etc.

In a preferable application, running line L of base material 6 should be at angle 8 satisfying the following formula (2) with tangent line $l_2$ at downstream end A of back edge face 2; see FIG. 2.

$$0.5° \leqq \theta \leqq 10° \quad (2)$$

If $\theta < 0.5°$, a force sufficient to press base material 6 against coater head CH is not available, and failures such as streaks are likely to occur. If $\theta > 0°$, smooth coat film is not available, and film thickness is subject to greater variations in the longitudinal direction of the sheet.

There is a space S between downstream end A of back face 2 and the center of downstream support roll 5. Space S should preferably be 5–50 mm. If $S < 5$ mm, base material 6 has to abruptly change its directions at downstream end A of back face 2, thereby jeopardizing the smoothness of the coated film. If $S > 50$ mm, a force pressing base material 6 is reduced, and the coating film thickness is likely to vary.

Base material 6 may be introduced into upstream support roll 4 and taken out of downstream support roll 5 in any direction.

COMPARATIVE TEST (2)

The effect of the invention is clarified using examples of coating.

A magnetic recording sheet is made up of polyethylene terephthalate film of 15 μm to which a high viscosity magnetic coating solution is coated to an intended dry film thickness of 3 μm; the solution contains metallic powder (with a BET value of 60 $m^3/g$) at 3000 cps.

Figure 5:
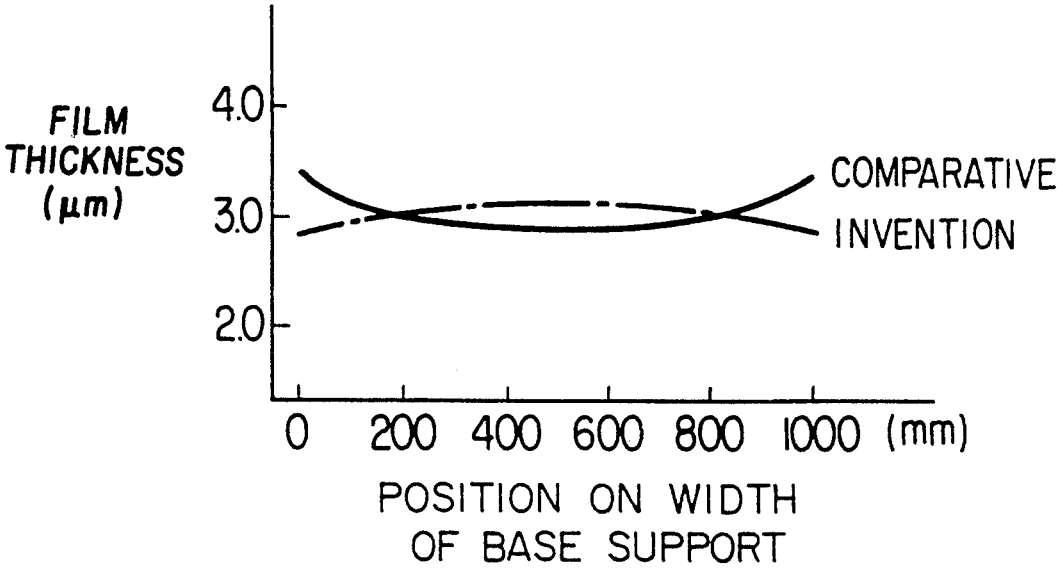
FIG. 5 is the comparative view illustrating the distribution of film thickness in the crosswise direction.
Figure 6:
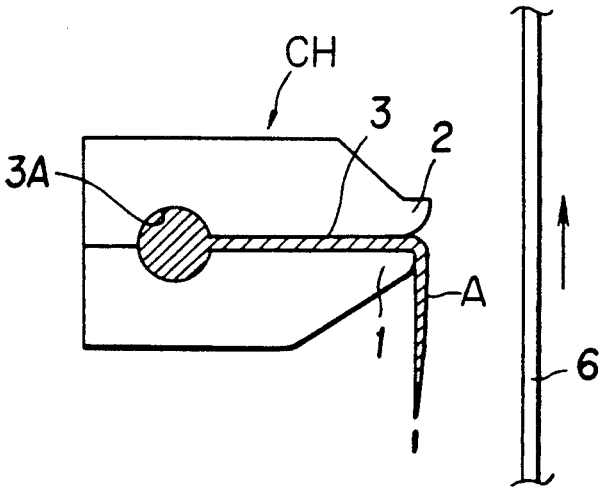
FIG. 6 illustrates outline of the coating apparatus of the present invention.

The present test was performed in two ways: One is to use fluid pressure means, and the other is not. In both ways, the average distribution of film thickness in the crosswise direction was measured; the test results are shown in FIG. 5. In the former way, the blow-out nozzle was internally divided into six chambers evenly with partition walls, and was provided with pressure control valves to control blow-out pressure.

FIG. 5 shows that variations of film thickness distribution are inhibited to an extremely low level.

For the purpose of experiment, various coating heads were manufactured and used together with the blow-out nozzle, which was located on front face 1 and back face 2, to find the optimal blow-out pressure. The inventor has found that optimal pressure results in excellent coating properties as compared with those where no blow-out nozzle is used.

The present test has proven that this invention ensures excellent coating properties while preventing uneven thicknesses and coating failures.

The third aim of the invention is to prevent coating failures caused by waste of the coating solution deposited on edge faces of the coater head, and is successfully attained using liquid repellent edges. More particularly, front face 1 (and preferably also back face 2) is made up of a liquid repellant material. Such material should have a contact angle $\theta$ with water of 63° or more, more preferably 68° or more. Typical examples include polyacetal resin, high-density polyethylene, fluorocarbon resin, and polyethylene terephthalate resin.

The present invention defines and measures contact angle $\theta$ with water as follows. Ionized water of about 5 μl is dripped onto a test specimen, when a water drop becomes a sphere on the surface of the test specimen. At the contact point between the sphere and surface of the test specimen, an angle formed by the tangent line of the sphere and the surface of the test specimen is measured 30 sec after ionized water is dripped, using a contact angle measuring device from Elma Optics Co.

COMPARATIVE TEST (3)

The comparative test (3) was performed as follows:

A polyethylene terephthalate film of 15 μm was used as the base material, to which a magnetic coating solution was coated to a wet film thickness of 40 μm at a coating rate of 100 m/min; the solution contains metallic powder (with a BET value of 55 $m^3/g$) at 3000 cps.

For the purpose of the test, coater heads made up of various materials were prepared and used to find the average of defect lengths caused by coating failures. Table 3 lists the test results.

TABLE 3

| | Material | Contact angle $\theta$ | Defect length due to coating failure: With cleaning device | Defect length due to coating failure: With no cleaning device |
|---|---|---|---|---|
| Selected | Teflon*1 | 95° | 0 m | 0.5 m |

TABLE 3-continued

| | Material | Contact angle θ | Defect length due to coating failure: With cleaning device | Defect length due to coating failure: With no cleaning device |
|---|---|---|---|---|
| example 1 | | | | |
| Selected example 2 | Polyfron*2 | 90° | 0 m | 1.2 m |
| Selected example 3 | High-density polyethylene | 70° | 5 m | 50 m |
| Selected example 4 | Polyacetal | 64° | 12 m | 59 m |
| Comparative example 1 | Iron | 55° | 199 m | 248 m |
| Comparative example 2 | Stainless steel (SUS 304) | 60° | 212 m | 293 m |

Notes:
*1 Made by Du Pont
*2 Made by Fron Industry Co.

The present test has proven that, the greater the contact angle, the fewer are the coating failures. For example, when a front face made up of polyacetal with a contact angle of 64° is used and cleaned as required, a coating failure may be limited within a range in which no trouble occurs in practical use. In addition, the test indicates that when a conventional coater head is used a defective length of 200 m or more occurs.

The present invention ensures that coating failures are greatly reduced, which are caused by waste of a coating solution left on edge faces of the coater head, and that an improved yield is attained.

Figure 7:
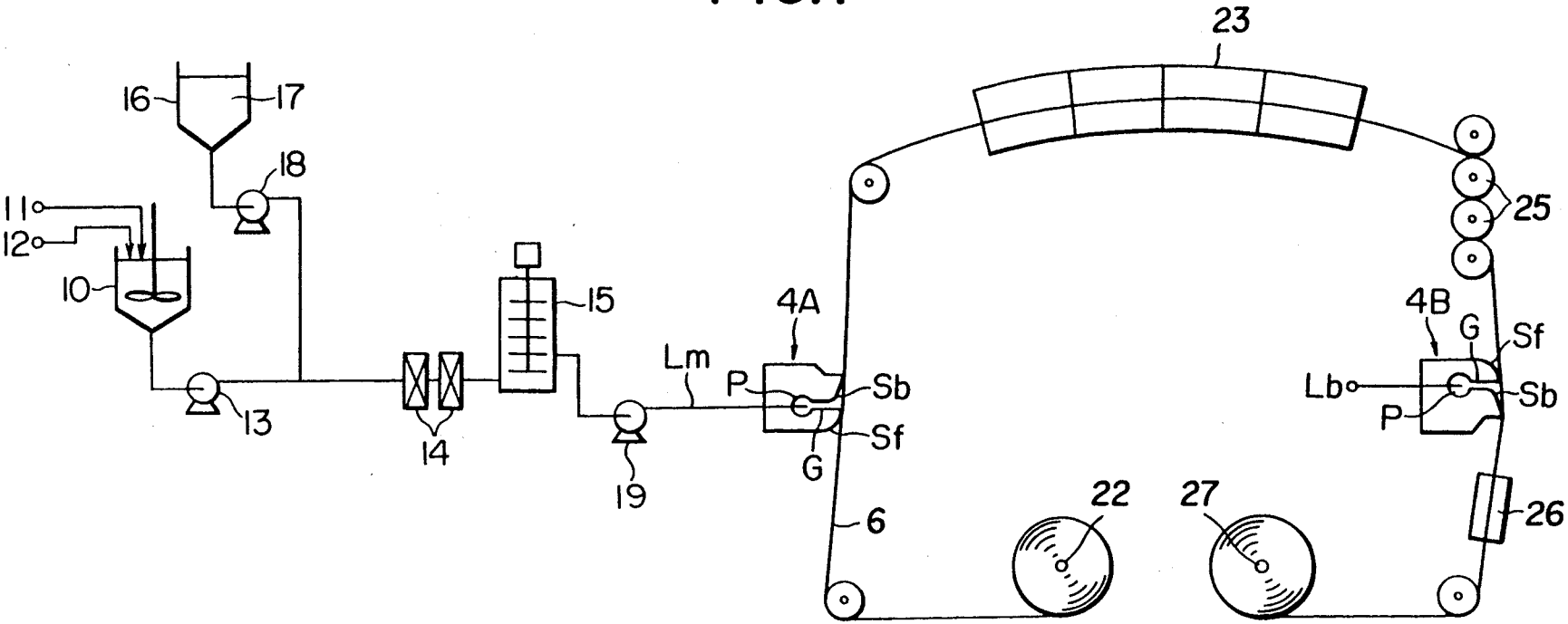
FIG. 7 illustrates the equipment used for the method of manufacturing magnetic recording media according to the present invention.

FIG. 7 outlines the equipment necessary for manufacturing magnetic recording media; the fourth aim of the invention. Base material 1 fed from roller 22 is coated on one surface with a magnetic coating solution Lm discharged from extrusion coater head No. 1 (4A) before reaching drying apparatus No. 1 (23). Magnetic coating solution Lm thus coated is dried by drying apparatus No. 1 (23) and is turned into a magnetic layer, which is then smoothed by calender roll 25. In the next step, base material 6 is coated on the other surface with a back-coating solution Lb discharged from coater head No. 2 (4B).

Solution Lb thus coated is dried by drying apparatus No. 2 (26) and is turned into a back-coating layer before base material 6 is wound by rewinder 27.

Coater heads 4A and 4B have front edge face Sf on the upstream side in the running direction of base material 1, and back-edge face Sb on the downstream side Slit G, provided between front-edge Sf and back-edge Sb, receives a coating solution continuously supplied by pocket P, and extrudes solution onto the surface of base material 6.

The magnetic coating solution is prepared as follows. Makeup tank 10 holds a solution which contains magnetic powder which has been pulverized with a ball mill, sand mill, or the like, and is dispersed in the solution. To the dispersion solution, additives 11 and 12 are added as required. Then, curing agent 17 is added to the dispersion solution from curing agent tank 16 by pump 18 before the dispersion solution is fed to disperser 15 through filter 14 by pump 13.

The magnetic coating solution (containing a curing agent) undergoes a shear stress (shearing force) of $1\times10^2$–$1\times10^5$ dyne/cm$^2$ in disperser 15 for at least 5 seconds, preferably for 10–60 seconds, and thereafter is led to pocket P of coater head No. 1 (4A) and is discharged onto base material 6 through slit G. The magnetic coating solution may preferably be applied within 20 seconds after magnetic powder is dispersed in the magnetic solution.

Coater head 4A may be the coater head as described earlier, that is, a known one. To prevent various coating failures, it is preferable to use the coater head according to the invention, that is, coater head 4A may preferably have a part of back face Sb projecting from tangent line $l_1$.

As a disperser for applying a required shear stress, a sand mill, high-speed dissolver, etc. may be used, but a static mixer or low-speed dissolver is not acceptable because of incapability of providing the necessary shear stress.

Figure 8:
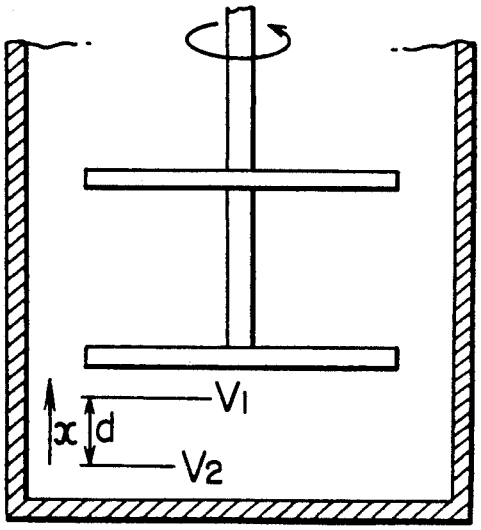
FIG. 8 illustrates how the shearing rate is calculated.

The shear stress is measured indirectly by measuring the viscosity of a coating solution using a precision viscometer such as a Harke viscometer. A simplified alternative is to find the shear stress using the following equations (1) and (2) assuming that the rate gradient is linear. Symbols in these equations are as described in FIG. 8.

$$r\ (\text{shear rate}) = \frac{V_1 - V_2}{d} = \frac{dV}{dX} \quad (1)$$

$$\text{shear stress } \tau = \eta r \quad (2)$$

$$\eta = \text{viscosity}$$

The present invention uses a variety of fine ferromagnetic powder; ferromagnetic oxide powder such as r-$Fe_2O_3$, r with Co-$Fe_2O_3$, Co coated r-$Fe_2O_3$, $Fe_3O_4$, Co-$Fe_3O_4$ and $CrO_2$, and metallic ferromagnetic powder with the content of Fe, Ni, Co, and Cr, such as Fe-Co-Ni alloy, Fe-Al alloy, MnBi alloy, Fe-Al-P alloy, Fe-Co-Ni-Cr alloy, Fe-Ni-Zn alloy, Fe-Co-Ni-P alloy, Fe-Ni alloy, Co-Ni-P alloy, Co-Ni alloy, Co-P alloy, Fe-Mn-Zn alloy, Fe-Ni-Mn alloy, Fe-Ni-Cr-P alloy, and Fe-Ni-Co-Zn alloy.

The binder used by the invention includes a vinylchloride-vinylacetate copolymer, vinylchloride-vinylidene chloride copolymer, vinylidene chloride-acrylonitrite copolymer, butyl acrylate-acrylonitrile copolymer, cellulose-base resin, epoxy resin, polyvinyl butyral resin, polyurethane resin, polyester resin, and synthetic-rubber-base resin.

The coating solution is dissolved in common organic solvents. To the coating solution added are, as required, the dispersion agent, lubricant, abrasive, destaticizer, curing agent, plasticizer, surface active agent, etc. The present invention is preferably applied when fine ferromagnetic powder has a specific area of 40 m$^3$/g or more and the binder has any of the following polar groups.

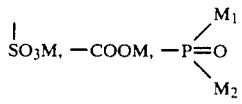

Here M stands for a hydrogen atom, lithium, potassium, or sodium, while $M_1$ and $M_2$ for a hydrogen atom, lithium, potassium, sodium, or arkyl base.

COMPARATIVE TEST (4)

The effect of the invention is clarified using the following examples.

TEXT EXAMPLES 4-1, 4-2, and 4-3

A polyethylene terephthalate film 1000 mm in width and 15 μm in thickness was used as the base material, on which a magnetic layer was formed using the coating apparatus illustrated in FIGS. 1 and 7.

The magnetic coating solution for the test contained metal powder (with a BET value of 55 $m^3/g$) and a vinylchloride vinyl acetate copolymer, and was applied at a viscosity of 2500 cps to a wet film thickness of 30 μm. The coating rate was 100 m/min.

Test examples 4-1, 4-2, and 4-3 were obtained by a high speed dissolver, sand mill A, and sand mill B, respectively.

COMPARATIVE EXAMPLES 4-1 TO 4-6

Comparative examples 4-1 to 4-6 show the result of tests which were intentionally deviated from requirements of the invention in the presence or absence of dissolver, the difference of dissolver, and binder with a polar group.

<RESULT>

Each of the nine examples was checked for a rise in viscosity as an index of stability of the coating solution and for deterioration of the magnetic recording medium obtained. Table 4 lists the test results.

TABLE 4

| | Coating apparatus | Polar group in binder | Disperser | Shear stress | Rise in viscosity | RF loss (dB) |
|---|---|---|---|---|---|---|
| Test example 4-1 | Extrusion | Present | High speed dissolver (4000 rpm) | $1.1 \times 10^2$ | None | −0.1 |
| Test example 4-2 | Extrusion | Present | Sand mill | $1.6 \times 10^4$ | None | 0 |
| Test example 4-3 | Extrusion | None | Sand mill | $1.6 \times 10^4$ | None | 0 |
| Comparative example 4-1 | Extrusion | Present | Static mixer | $0.5 \times 10$ | None | −0.5 |
| Comparative example 4-2 | Extrusion | Present | Dissolver (500 rpm) | $1.3 \times 10$ | None | −0.5 |
| Comparative example 4-3 | Extrusion | Present | None | — | None | −1.5 |
| Comparative example 4-4 | Extrusion | None | None | — | None | −1.2 |
| Comparative example 4-5 | Gravure | Present | Sand mill | $1.6 \times 10^4$ | 2 times | −0.5 |
| Comparative example 4-6 | Gravure | None | Sand mill | $1.6 \times 10^4$ | 1.5 times | −0.4 |

In conclusion, the invention improves stability of the magnetic coating solution and provides magnetic recording media having excellent recording and playback characteristics.

The fifth aim of the invention is to form a back-coating layer in a series of coating operations in the manufacturing process of magnetic recording media, and is successfully attained by use of the coating apparatus illustrated in FIG. 7.

The back coating is prepared in the same way as the magnetic coating solution, except that fine magnetic powder is not used. An inorganic filler, carbon, $CaSO_4$, $TiO_2$, etc. may be used. Materials of the back-coating layer may be selected from those of the magnetic layer; the binder, coating solution, and additive are as described earlier.

The back-coating layer may be formed to a thickness of 0.1–5 μm, but more preferably to a thickness of 0.2–0.3 μm.

COMPARATIVE TEST (5)

The effect of the invention is clarified using the following examples.

TEST EXAMPLE 5-1

A polyethylene terephthalate film 1000 mm in width and 15 m in thickness was used as the base material, on which the magnetic layer and back-coating layer were formed using the coating apparatus illustrated in FIGS. 1 and 7. The coating apparatus was run at a coating rate of 100 m/min.

The magnetic coating solution contained metal powder (with a BET value of 60 $m^3/g$) and a vinylchloride and vinylacetate copolymer, and was applied at a viscosity of 2500 cps to a wet film thickness of 30 μm.

The back-coating solution had a viscosity of 1500 cps, consisting mainly of polyurethane resin having fluorine, and was applied to a dry film thickness of 2 μm.

COMPARATIVE EXAMPLES 5-1 TO 5-3

Comparative examples 5-1, 5-2, and 5-3 were obtained using the gravure roll, reverse roll, and knife coater, respectively, which substituted for the extrusion-type coating apparatus to apply the back-coating solution. Any other coating conditions were left unchanged.

<RESULT>

The magnetic recording medium thus obtained was checked for dropouts at −12 dB and variations of film thickness in the longitudinal direction; Table 5 lists the test results.

TABLE 5

| | | D/0 (10 μS/3 μS) | Rate of variation |
|---|---|---|---|
| Test example 5-1 | Extrusion | 0/2 | ±5% |
| Comparative example 5-1 | Gravure roll | 1/7 | ±8% |
| Comparative example 5-2 | Reverse roll | 2/8 | ±20% |
| Comparative example 5-3 | Knife coater | 2/7 | ±35% |

The present test has proven that the invention ensures uniform distribution of film thickness in the longitudinal direction and provides magnetic recording media with fewer dropouts.

Thus, the invention can manufacture magnetic recording media which feature reduced dropouts and whole back-coating layer has fewer variations in film thickness.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for coating a flexible support with a coating solution from a supply thereof comprising:

a coating head having a coating surface including an upstream side and a downstream side;

means for moving the support along the coating surface, the coating surface defining a front face disposed on the upstream side of the coating surface and a back face disposed on the downstream side of the coating surface;

a slit in the coating surface between the front and back faces, the slit being in communication with the supply of the coating solution, for extruding the coating solution through the slit onto the flexible support as the support moves along the coating surface from the front face to the back face;

the front face including an introducing segment, a turning portion and an end section, wherein the end section has a radius of curvature $r_1$;

the back face including an arcuate surface having radius of curvature $r_2$ along its entirety, the radii of curvature being related according to the relationships;

$$1\ \text{mm} < r_1 < r_2/2\ \text{ps}$$
$$3\ \text{mm} < r_2 < 20\ \text{mm; and}$$

the end section having a downstream end and at least a art of the back face extending beyond a line tangent to the downstream end of the front face.

2. The apparatus of claim 4 wherein the introducing segment of the front face is curved.

3. The apparatus of claim 4 wherein the introducing segment of the front face is planar.

4. The apparatus of claim 4 wherein the part of the back face extending beyond the tangent line at the downstream end of the front face includes a stop surface for interrupting the flexible support from contacting the downstream end of the front face, and preventing the support from being shaved by the downstream end.

5. The apparatus of claim 4 wherein $r_1$ and $r_2$ are 1.5 mm and 8 mm, respectively.

6. The apparatus according to claim 4 further comprising a support roll arranged on each of the upstream and downstream sides of the coating surface, for pressing the flexible support onto the coating surface, and fluid pressure means for providing fluid pressure on the flexible support at the front face to tension the flexible support.

7. The apparatus of claim 4 wherein the downstream end of the front face has a length sufficient to form an angle of about 30° to 120° between a line connecting the radius curvature center of the downstream end of the end section and a line connecting the radius of curvature center to the turning portion.

8. The apparatus of claim 7 wherein the angle is preferably of about 75° to 100°.

* * * * *

UNITED STATES PATENT AND TRADEMARK OFFICE

CERTIFICATE OF CORRECTION

PATENT NO. : 4,995,339

DATED : February 26, 1991

INVENTOR(S) : Seiichi Tobisawa et al.

It is certified that error appears in the above-identified patent and that said Letters Patent is hereby corrected as shown below:

Claim 1, column 15, line 36, before "radius" insert --a--

Claim 1, column 16, line 4, after "$r_2/2$" delete [ps]

Claim 1, column 16, line 8, change "art" to --part--

Claim 2, column 16, line 10, change "4" to --1--

Claim 3, column 16, line 12, change "4" to --1--

Claim 4, column 16 line 14, after "claim" change "4" to --1--

UNITED STATES PATENT AND TRADEMARK OFFICE

CERTIFICATE OF CORRECTION

PATENT NO. : 4,995,339

DATED : February 26, 1991

INVENTOR(S) : Seiichi Tobisawa, et. al.

It is certified that error appears in the above-identified patent and that said Letters Patent is hereby corrected as shown below:

Claim 5, column 16, line 20, change "4" to --1--

Claim 6, column 16, line 22, change "4" to --1--

Claim 7, column 16, line 29, change "4" to --1--

Signed and Sealed this

Twenty-ninth Day of December, 1992

*Attest:*

DOUGLAS B. COMER

*Attesting Officer*

*Acting Commissioner of Patents and Trademarks*